United States Patent [19]

Rosselet

[11] 4,291,628

[45] Sep. 29, 1981

[54] SAFETY MECHANISM FOR FUSES

[75] Inventor: Jean Rosselet, Geneva, Switzerland

[73] Assignee: Mefina S.A., Fribourg, Switzerland

[21] Appl. No.: 45,628

[22] Filed: Jun. 5, 1979

[30] Foreign Application Priority Data

Jun. 12, 1978 [CH] Switzerland ..... 6357/78

[51] Int. Cl.[3] ..... F42C 9/02

[52] U.S. Cl. ..... 102/276; 74/1.5; 368/124

[58] Field of Search ..... 102/276, 254, 255, 256, 102/257, 232, 238; 74/1.5; 368/124, 125, 127–131

[56] References Cited

U.S. PATENT DOCUMENTS 1,273,734 7/1918 Chaînat ..... 74/1.5
2,725,716 12/1955 Varaud ..... 368/124
3,017,742 1/1962 Reinhardt ..... 368/175
3,293,922 12/1966 Pittman ..... 74/1.5
3,685,277 8/1972 Fedchenko ..... 74/1.5
3,715,989 2/1973 Apotheloz ..... 74/1.5 X

*Primary Examiner*—David H. Brown
*Attorney, Agent, or Firm*—Emory L. Groff, Jr.

[57] ABSTRACT

A safety mechanism for the trajectory for a projectile fuse.

The mechanism uses a symmetrical escapement of the cylindrical dead-beat type which does not comprise an inlet lip. The balance comprises two cheeks located one on each side of the escapement wheel, a cylindrical sector being provided on each cheek. Impulses provided by the escapement wheel are transmitted alternately to one of the two sectors then to the other sector, thereby causing the balance to oscillate first in one direction and then in the opposite direction.

10 Claims, 25 Drawing Figures

Fig. 3.
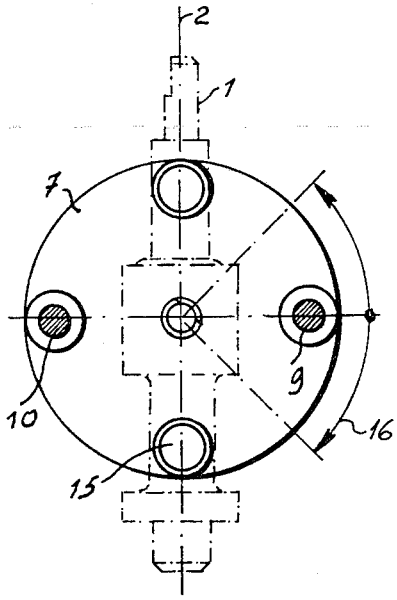
Fig. 1.
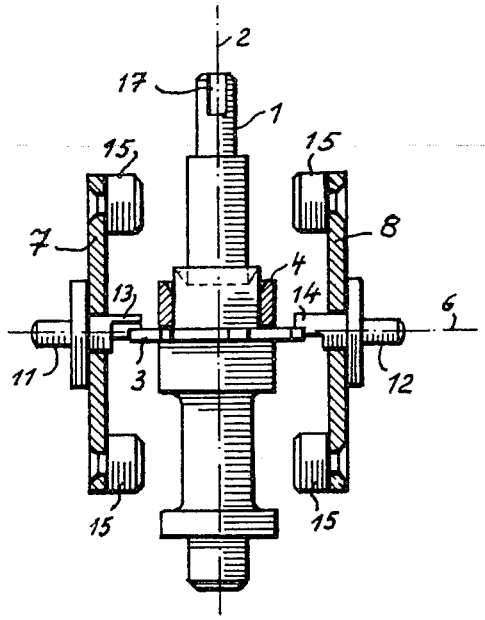
Fig. 5.
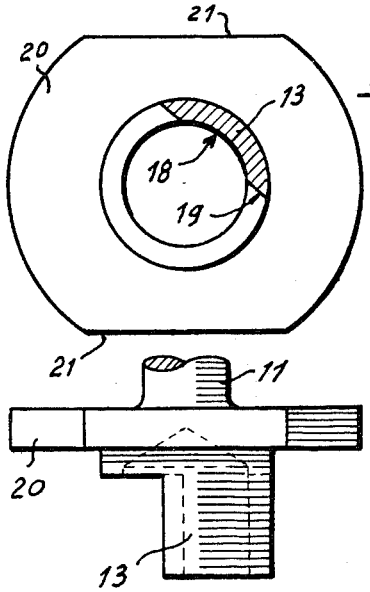
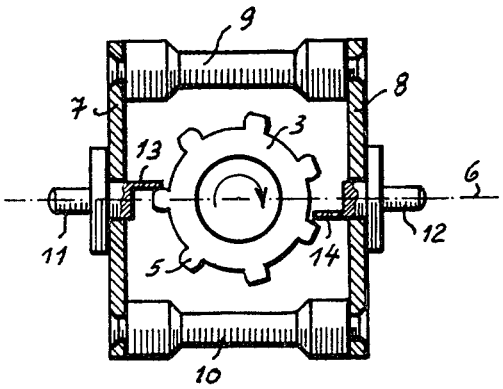
Fig. 4.
Fig. 2.

Fig. 7.
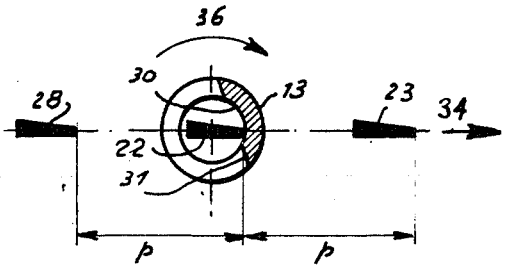
Fig. 10.
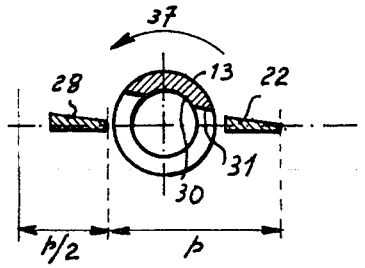
Fig. 6.
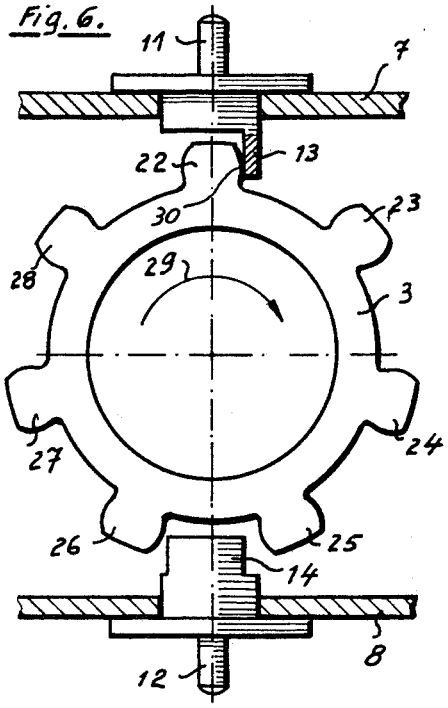
Fig. 9.
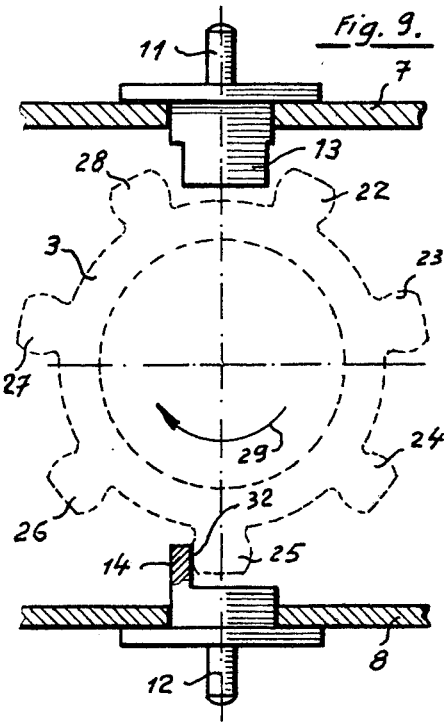
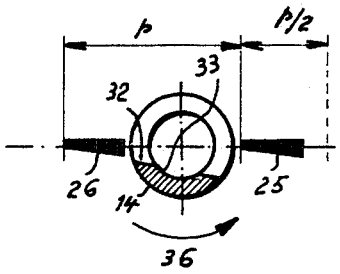
Fig. 8.
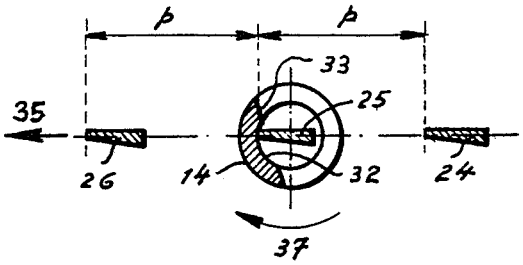
Fig. 11.

Fig. 15.
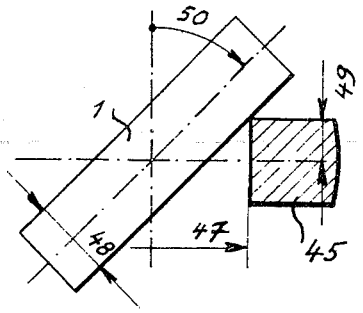
Fig. 12.
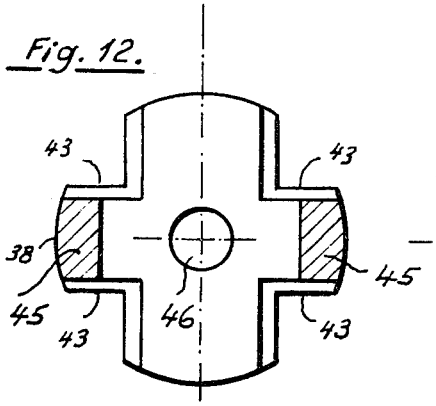
Fig. 13.
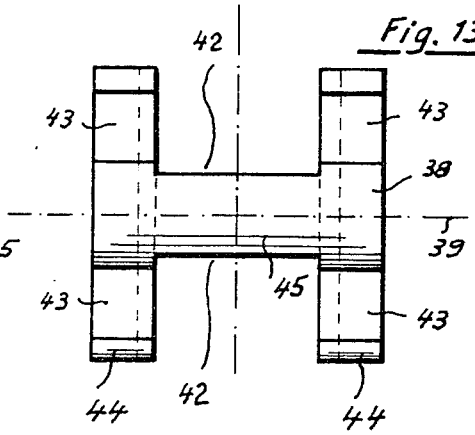
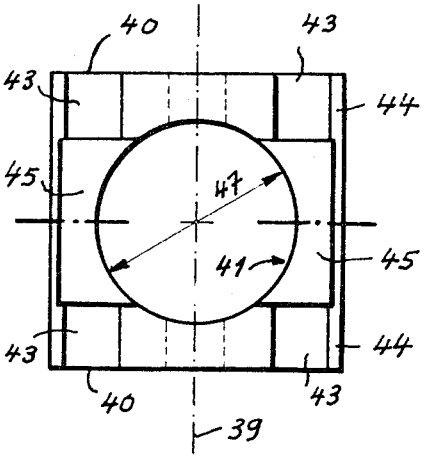
Fig. 14.

Fig. 17.
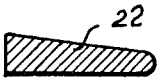
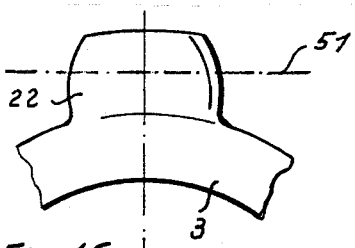
Fig. 16.
Fig. 18.
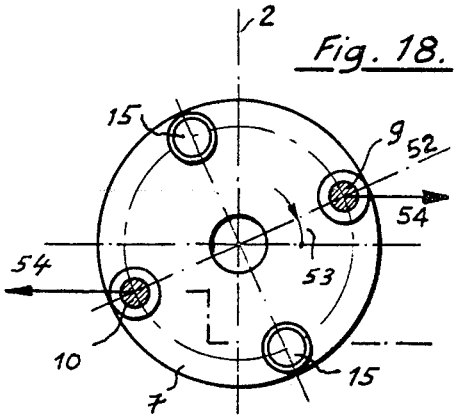
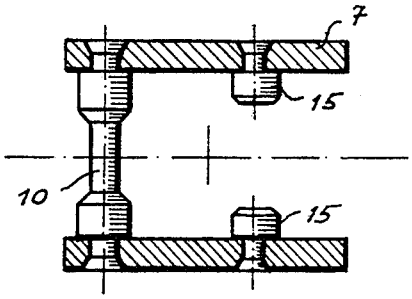
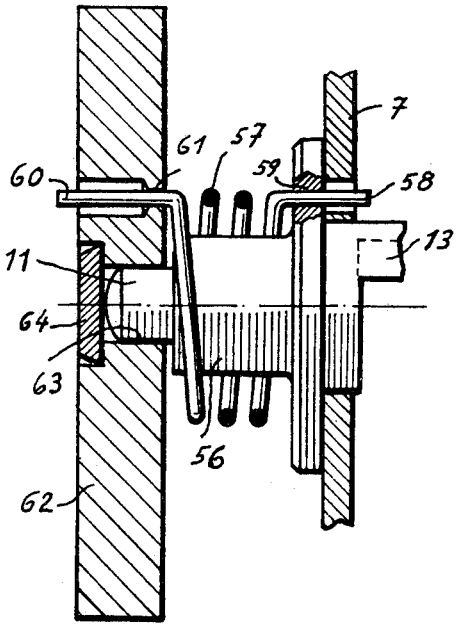
Fig. 21.
Fig. 19.
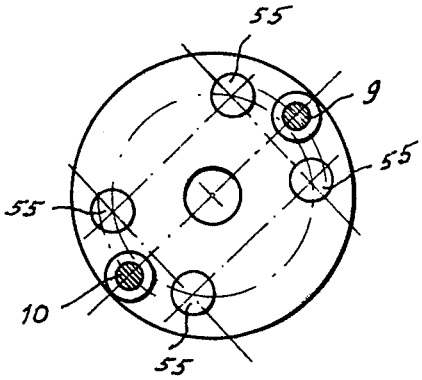
Fig. 20.

Fig. 22.
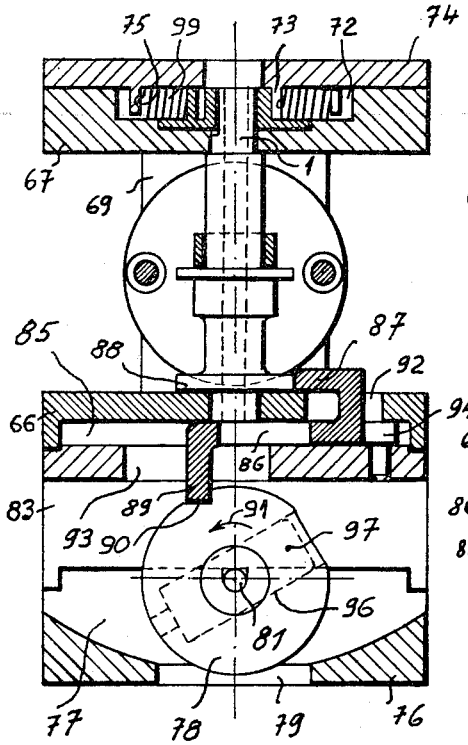
Fig. 23.
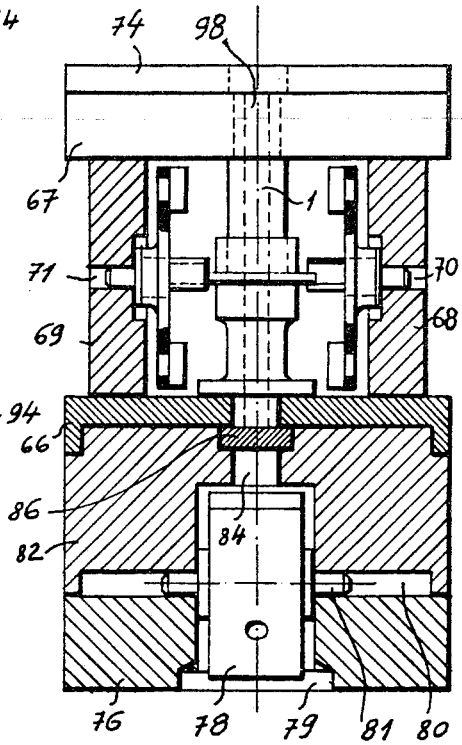
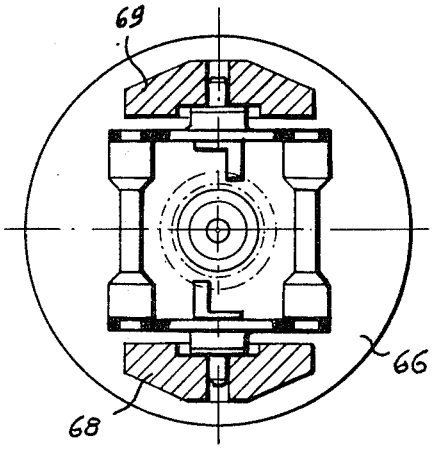
Fig. 24.
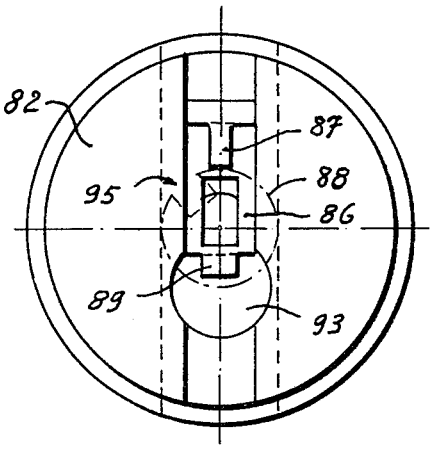
Fig. 25.

SAFETY MECHANISM FOR FUSES

The present invention relates to a safety mechanism for fuses for projectiles, bombs, mines and other explosive devices.

A safety mechanism for fuses is known which comprises a central shaft acted upon by a motor spring and a balance which can effect oscillations around an axis perpendicular to the axis of the central shaft. The balance includes an escapement cylinder comprising an entry lip, an inner locking surface, an exit lip and an outer locking surface, as can be seen in Swiss Pat. No. 319,610. This escapement is not symmetrical. The functioning of the entry lip, which is delicate, is easily disturbed by the variations in the position of the movable members, these variations in position being due to the play existing between such members.

The present invention seeks to provide a safety mechanism which overcomes or at least minimizes the disadvantages of the above-mentioned mechanism, by providing a perfectly symmetrical escapement which comprises only inner locking surfaces and exit lips. It does not have any entry lips, so that the problems caused by the entry lip in the known arrangement are eliminated.

The mechanism in accordance with the invention can provide safety for large trajectories, of the order of 20 to 150 meters or even more, in accordance with the calibres.

According to the present invention there is provided a safety mechanism for fuses for projectiles, bombs, mines or explosive appliances, the mechanism being intended to delay the arming of the fuse from the moment of driven release, the mechanism comprising a central shaft having an axis, a motor spring acting on said central shaft and, adapted to rotate it around its axis, a balance capable of effecting sustained oscillations around an axis extending perpendicularly to the axis of the central shaft, the two axes being concurrent, a mechanical connection between the central shaft and the balance being provided in the form of a dead-beat escapement, the arming of the fuse becoming effective when the central shaft has effected a predetermined angular rotation corresponding to a predetermined number of oscillations of the balance, wherein the escapement comprises an escapement wheel secured to the central shaft, the wheel having an odd number of teeth, and the balance comprises two lateral cheeks, disposed one on each side of the central shaft, which cheeks are fixedly connected to one another, each cheek comprising a cylindrical sector, the geometric axis thereof coinciding with the axis of oscillation of the balance, which sector co-operates with the teeth of the escapement wheel, each cylindrical sector comprising an inner locking cylindrical surface and an exit lip which constitute the active surface of the cylindrical sector, the successive locks of the teeth followed by successive impulses of the teeth being effected alternatively on the active surface of the first of the cylindrical sectors, thereby causing the balance to oscillate in a first direction, and the second cylindrical sector, thereby causing the balance to oscillate in a second direction opposite to said first direction.

The invention will be further described, by way of example, with reference to the accompanying drawings, in which:

FIG. 1 is an elevational view, partially in section, of an escapement mechanism;

FIG. 2 is a plan view, also partially in section, of the mechanism shown in FIG. 1;

FIG. 3 is a lateral section through the mechanism shown in FIG. 1;

FIGS. 4 and 5 each show details of the mechanism shown in FIGS. 1 to 3;

FIGS. 6, 7, 8, 9, 10 and 11 each illustrate operational positions of the escapement mechanism;

FIG. 12 is a transverse section through a balance;

FIG. 13 is an axial view of the balance shown in FIG. 12;

FIG. 14 is a plan view of the balance shown in FIGS. 12 and 13;

FIG. 15 specifies the determination of an important dimension of the balance shown in FIGS. 12, 13 and 14.

FIGS. 16 and 17 each show views of a tooth of the escapement wheel;

FIGS. 18 and 19 each show views of a balance used in gyratory projectile fuses;

FIG. 20 is an elevational section through a balance;

FIG. 21 is an elevational section of a part of the balance;

FIG. 22 is an elevational section of a mechanism;

FIG. 23 is a partial lateral section of the mechanism shown in FIG. 22;

FIG. 24 is a plan section of the mechanism shown in FIG. 22; and

FIG. 25 is a plan view of the lower part of the mechanism shown in FIGS. 22, 23 and 24.

There is shown, in FIGS. 1, 2 and 3, an escapement mechanism comprising a central shaft 1 having a longitudinal axis 2, an escapement wheel 3 being fixedly secured to the central shaft 1. The escapement wheel 3 is maintained set on the central shaft 1 by means of a ring 4. The escapement wheel comprises seven teeth 5. The ends of the central shaft 1 are guided in journals (not shown).

The escapement mechanism includes a balance having an axis 6, which axis extends perpendicularly to the axis 2 of the central shaft 1. These two axes 2 and 6 are, moreover, intersecting so that the axis 6 is thus diametrical.

The balance comprises two cheeks 7 and 8, which are situated one on each side of the central shaft 1, the cheeks being secured together by two diametrically opposed struts 9 and 10, each strut being riveted onto both cheeks 7 and 8. The cheek 7 is provided with a pivot 11 having a cylindrical sector 13 and the cheek 8 with a pivot 12 having a cylindrical sector 14. The two cylindrical sectors 13 and 14 each co-operate with the teeth 5 of the escapement wheel 3 and constitute a dead-beat escapement which will be described in greater detail hereinafter.

The balance further comprises four regulating weights 15 which permit counterbalancing, the centrifugal moment of inertia, $\int xy \cdot dm$, of the balance, or the limitation thereof, to a chosen value.

The balance can effect oscillations around the axis 6, the maximum amplitude 16 of which, as shown in FIG. 3, is limited by the struts 9 and 10, which must not touch the central shaft 1.

The central shaft 1 has a flat 17 permitting it to be driven.

There is shown in FIGS. 4 and 5, on an enlarged scale, the pivot 11 shown in FIG. 1, which comprises a cylindrical sector 13 formed by the remaining portion of a countersunk hollow cylinder so as to define an inner locking surface 18 and an exit lip 19. The surfaces 18 and the lip 19 form the active surface of the cylindrical sector 13.

The pivot 11 also comprises a bearing 20. This bearing 20 has two parallel faces 21 permitting the setting of the exit lip 19, when the pivot 11 is mounted on the cheek 7 of the balance. The two pivots 11 and 12 with their respective sectors 13 and 14 and their bearings 20 are identical.

In FIGS. 6, 7, 8, 9, 10 and 11, there is shown the escapement wheel 3, the two cheeks 7 and 8 of the balance having the pivots 11 and 12, with their respective cylindrical sectors 13 and 14 mounted thereon. The escapement wheel 3 has seven teeth 22, 23, 24, 25, 26, 27 and 28 and rotates in the direction of the arrow 29.

The cylindrical sector 13 comprises an inner cylindrical surface now referenced 30 and an exit lip now referenced 31. The cylindrical sector 14 similarly comprises an inner cylindrical surface 32 and an exit lip 33.

In FIGS. 7, 8, 10 and 11, the teeth of the escapement wheel are shown as having been developed. They are spaced apart at the mean gap of the teeth, that is to say, the pitch p. The arrows 36 and 37 indicate the direction of displacement of the escapement wheel.

The functioning of this escapement will now be described. FIGS. 6, 7 and 8 each show the escapement wheel and the cylindrical sectors 13 and 14 in well defined positions.

The tooth 22 is at rest against the inner cylindrical locking surface 30 (FIGS. 6 and 7) of the cylindrical sector 13. The balance oscillates in the direction of the arrow 36, attains its maximum amplitude and then oscillates in the direction opposite to the arrow 36. At a given moment in time, the tooth 22 passes under the exit lip 31 and gives an impulse to the balance. The tooth 22 is thus freed and the escapement wheel 3 rotates in the direction of the arrow 29. The wheel is stopped by the tooth 25 coming to bear against the inner cylindrical locking surface 32 (FIGS. 9 and 11) of the cylindrical sector 14.

The escapement wheel has thus advanced one half-pitch, p/2, as shown in FIG. 10. It thus occupies the position shown in broken lines in FIG. 9 and two teeth on FIG. 6.

The balance continues to oscillate in the direction of the arrow 37 (FIG. 11), attains its maximum amplitude and then oscillates in the direction opposite to the arrow 37. At a given moment in time, the tooth 25 passes under the exit lip 33 and gives an impulse to the balance. The tooth 25 is thus freed and the escapement wheel 3 rotates in the direction of the arrow 29. The wheel is stopped by the tooth 28 (FIGS. 6 and 9) coming to bear against the inner cylindrical locking surface 30 of the cylindrical sector 13 (FIGS. 6 and 7). The escapement wheel has therefore advanced a further half-pitch effectively returning it to its rest position shown in FIG. 6. The cycle then recommences.

As can be seen, the resting of the teeth of the escapement wheel followed by impulses of the teeth acting on the active surface of one of the cylindrical sectors causes the balance to oscillate first in one direction and then, by acting on the active surface of the other cylindrical sector, causes it to oscillate in the reverse direction.

In FIGS. 12, 13 and 14, there is shown a one-piece balance which is in the form of a cylindrical body having an axis 39, having two parallel bases 40. The body is provided with a central bore 41 extending perpendicularly to the axis 39. Parallel to the two bases 40, it comprises two counter-sunk portions 42, which are parallel to each other and are symmetrical with respect to the axis 39.

To reduce the centrifugal moment of inertia, $\int xy \cdot dm$, of the balance, this latter comprises four countersunk parts 43 parallel to, and symmetrical with respect to the axis 39.

The material adjacent to each of the bases 40 forms the cheeks 44 of the balance as can be seen in FIG. 13. The two cheeks 44 are secured by two bridges 45 which are shown cross-hatched in FIG. 12. Each cheek 44 has a central bore 46 for the mounting of the pivots of the balance.

The diameter 47 of the bore 41 is determined by the diameter 48 of the central shaft 1, by the half-height 49 of the bridges 45 and by the maximum amplitude of oscillation 50 of the balance as is shown in FIG. 15.

In FIG. 16 there is shown part of the escapement wheel 3 and a tooth 22. The profile of the tooth 22, viewed along the axial section line 51 in FIG. 16, is shown in FIG. 17. The profile has, however, the form which gives the best performance of the escapement in the particular circumstances under which it is to be employed. This form can be determined experimentally.

There is shown, in FIGS. 18 and 19, part of a balance. The balance comprises the cheek 7, the two struts 9 and 10 located on a diameter 52 and two regulating weights 15, located on a diameter at right angles to the diameter 52. The balance is shown in the position it occupies when it has effected an oscillation of an amplitude referenced 53. The axis 2, which is the axis of the central shaft 1, is the axis of gyration of the fuse. The amplitude 53 is measured with respect to a diameter extending perpendicularly to the axis 2.

The speed of gyration of the fuse is assumed to be $\Omega$Rad/sec and, to simplify calculations, the two struts 9 and 10 and the regulating weights 15, four in all, are assumed to be of the same diameter.

If it is assumed that the two struts each have a weight $m_1$, and the four regulating weights each have a weight of $m_2$, then the centrifugal moment of inertia ($\int xy \cdot dm$) is zero if $2m_1 = 4m_2$.

The following condition is worked out $2m_1 > 4m_2$ $2m_1 - 4m_2 = 2\Delta m$, that is to say, $m_1 - 2m_2 = \Delta m$ where $\Delta m$ is the excess of the weight of one strut.

When the fuse rotates around the axis 2, the two struts create two equal centrifugal forces 54 which set up a centrifugal couple, the moment ($C_c$) of which is $\Delta m \cdot \Omega^2 \cdot r^2 \cdot \sin 2\alpha$ where $\alpha$ is the instantaneous amplitude, and r is the radius. The couple is at a maximum when $\alpha$ is 45°.

This couple constitutes the return couple of the balance, when the safety mechanism is used in a gyratory fuse. By varying $\Delta m$, the desired return couple can be obtained. The regulating weights serve to totally or partially counterbalance the weights of the struts 9 and 10, or, also the weights of the bridges 45 of the balance shown in FIGS. 12, 13 and 14. This equilibrium can also be achieved by providing four bores 55 in the region of the struts 9 and 10, which bores are symmetrically located with respect to the struts 9 and 10, as can be seen in FIG. 20.

In FIG. 21, there is shown one of the cheeks 7, of a balance, the pivot 11 and the cylindrical sector 13. The pivot 11 of the balance comprises a cylindrical bearing 56 which guides a helicoidal torsion spring 57. One end 58 of the spring 57 engages in a hole 59 formed in the pivot 11 and the other end 60 of the spring engages in a hole 61 formed in a balance journal 62. The balance journal 62 has a bore 63 formed therein for the balance pivot 11, which latter bears against a bearing member 64 set in the journal 62. The torsion spring provides the return couple of the balance when the safety mechanism is used in projectile fuses and in non-gyratory explosive devices.

There is shown in FIGS. 22 to 25 a safety mechanism to provide trajectory security for a fuse which also provides detonator security. In this embodiment, the fuse is mounted on a gyratory projectile.

The integers described and shown in FIGS. 1, 2 and 3 are present in such an arrangement. Thus, there is the central shaft 1 having an axis 2, the escapement wheel 3, the ring 4, the two cheeks 7 and 8, the two struts 9 and 10, the two pivots 11 and 12, the cylindrical sectors 13 and 14 and the four regulating weights 15, the operation of which has already been described. The axis 2 is the axis of gyration of both the fuse and the mechanism.

The central shaft 1 is pivotally in a lower plate 66 and an upper plate 67. The two plates 66 and 67 are fixed to two journals 68 and 69 respectively by means of screws (not shown). The journals 68 and 69 each have a diametrical bore 70 and 71 respectively formed therein for the mounting of the pivots 11 and 12 respectively of the balance.

The upper plate 67 includes a housing 72 for a plug 73, for driving the central shaft 1, and for a motor spring in the form of a spiral spring 99 which functions as a barrel spring driving central shaft 1. The housing 72 is closed by a cover 74 in the form of a split crown 75. The spiral spring 99 located in the housing 72, is fixed at its inner end to the plug 73 and at its outer end to the crown 75. The spiral spring 99 is armed by rotating the cover in the direction of rotation of the central shaft 1.

The lower plate 66 is laid and centered on the safety mechanism of the detonator which comprises a base portion 76 having a diametrical counter-bore 77 for housing a rotor 78, a central aperture 79, and a groove 80 permitting the passage of two rotor pivots 81. The rotor is maintained in its rest position by known means, not shown, such as non-return cotter pin or centrifugal pistons.

The base 76 is surmounted by a guide body 82, centered on the base 76, the body 82 comprising a diametrical counter-bore 83, also serving to house the rotor 78 in conjunction with the bore 77. The guide body has a central aperture 84 and a diametrical guide groove 85 in which a bolt 86 is guided.

The bolt 86 comprises an upper beak portion 87 bearing against a cam 88 fixed to the central shaft 1 and a lower beak portion 89 engaging in a counter-bore 90 formed in the rotor 78. This prevents the rotor from rotating in the direction of the arrow 91. The upper beak 87 passes over the plate 66 across an opening 92. The lower beak passes beneath the guide groove 85 across an opening 93.

The bolt is maintained radially by means of a cotter pin 94, whilst the cam 88 has an entry portion 95.

The rotor further comprises a housing 96 for a detonator cap 97. The central shaft has an axial hole 98 formed therein for the passage of a plunger not shown.

The functioning of the described mechanism will now be described. At rest, the balance of the safety mechanism is locked in a position different to its equilibrium position (oscillation amplitude of zero) preferably at its maximum oscillation amplitude, by means not shown. The motor spring is armed.

In the position shown, the explosion of the blasting-cap 97 cannot be transmitted to the detonator located below the base 76. This is the detonator safety device.

At the outset of the blast, the balance is freed, as well as the rotor 78. At the exit of the mouth of the barrel, the balance starts its oscillations and the central shaft, driven by the motor spring, rotates thereby driving the escapement wheel which maintains the oscillations of the balance.

After a rotation determined by the central shaft 1, corresponding to a predetermined number of oscillations of the balance, the bolt enters into the entry 95 of the cam 88 in displacing itself to the left as shown in FIG. 22. This will occur at a predetermined time. Such action frees the rotor 78 which rotates in the direction of the arrow 91, to bring the axis of the percussion cap into the axis 2. The fuse is armed. The plunger can explode the detonator cap 97, the explosion of which is transmitted by the hole 79.

The displacement of the bolt 86 towards the left is effected by the centrifugal couple of the rotor 78, which tends to rotate it in the direction of the arrow 91. This couple has a relatively large value and its pressure acting on the lower beak portion 89, when transmitted to the upper beak portion 87 could jam the central shaft 1. To reduce this pressure, the centre of gravity of the bolt 86 is located near the upper beak portion 87. The centrifugal force of the bolt 86, opposing the pressure of the rotor, permits a reduction of the pressure of the upper beak portion 87 on the cam 88, and prevents jamming of the shaft 1.

The cam 88, fixedly mounted on the central shaft 1 can also control the arming of the fuse which could be effected by an electronic device. For example, the cam could control the closure of a feed switch for such an electronic device. The central shaft could have a toothed pinion mounted thereon instead of a cam. This pinion would drive a toothed wheel secured to another shaft. This would increase the security of the trajectory, it being understood that the central shaft can effect a rotation greater than one turn.

The security of the trajectory is a function of the frequency of the balance. This frequency depends on the return couple of the balance and of the moment of inertia of the weight of the balance.

In all of the described examples, the two balance pivots are secured to the balance. These pivots could, however, equally well be secured to the framework of the balance, whilst the two lateral cheeks of the balance could comprise two bores for the pivots.

I claim:

1. A safety mechanism for fuses for projectiles, bombs, mines and other explosive devices, said mechanism delaying the arming of the fuse and comprising a central shaft, said central shaft having an axis, a motor spring acting on said central shaft for rotating said shaft about said axis, escapement means mounted on said shaft and a balance acted upon by said escapement means, said escapement means forming a mechanical connection between said shaft and said balance in the form of a dead-beat escapement, said balance, having a balance axis, said axis extending perpendicularly to said shaft axis but intersecting therewith, said balance being capable of effecting sustained oscillations around said balance axis, said escapement means comprising a toothed escapement wheel fixedly mounted on said central shaft, said wheel having an odd number of teeth, said balance comprising two lateral cheeks, said cheeks being disposed one on each side of said central shaft, connecting means connecting said cheeks to one another, each said cheek comprising a cylindrical sector, each said sector having a geometric axis, each said axis being coincident with said balance axis, each said sector defining an inner locking cylindrical surface and an exit lip, said surface and said lip constituting the active surface of said sector, said active surface being acted upon by said teeth of said escapement wheel, whereby successive locking and impulsing of said teeth of said escapement wheel act alternately on said active surfaces of said cylindrical sectors of said balance, thereby causing said balance to oscillate in two opposed directions, each said oscillation of said balance causing angular rotation of said central shaft, a predetermined angular rotation of said shaft causing arming of said fuse.

2. A mechanism as recited in claim 1 wherein said balance has a center of gravity, said centre of gravity lying on said balance axis.

3. A mechanism as recited in claim 1 wherein said balance has an equilibrium position, said equilibrium position corresponding to zero amplitude of oscillation, said balance further being lockable in a rest position, said rest position and said equilibrium position being different.

4. A mechanism as recited in claim 1 wherein said sectors are identical to one another.

5. A mechanism as recited in claim 1 further comprising pivot means for said balance formed on said sectors.

6. A mechanism as recited in claim 1 wherein said sectors are formed on said cheeks of said balance.

7. A mechanism as recited in claim 1 wherein said balance is a unitary structure, said structure having pivots inserted therein.

8. A mechanism as recited in claim 1 further comprising cam means mounted on said shaft, said cam means controlling said arming of said fuse.

9. A mechanism as recited in claim 1 wherein said central shaft defines an axial bore, said axial bore permitting the passage of a plunger.

10. A mechanism as recited in claim 1 wherein said balance has a centrifugal moment of inertia which is not zero.

* * * * *